US009039316B2

(12) United States Patent
Rolion et al.

(10) Patent No.: US 9,039,316 B2
(45) Date of Patent: May 26, 2015

(54) WRITING INSTRUMENT HAVING A PROTECTIVE ELEMENT FOR THE RETRACTABLE TIP

(71) Applicant: Societe BIC, Clichy Cedex (FR)

(72) Inventors: Franck Rolion, Asnieres sur Oise (FR); Ludovic Fagu, Noisy le Sec (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 14/376,466

(22) PCT Filed: Jan. 16, 2013

(86) PCT No.: PCT/FR2013/050099
§ 371 (c)(1),
(2) Date: Aug. 4, 2014

(87) PCT Pub. No.: WO2013/114018
PCT Pub. Date: Aug. 8, 2013

(65) Prior Publication Data

US 2015/0050062 A1 Feb. 19, 2015

(30) Foreign Application Priority Data

Feb. 3, 2012 (FR) ..... 12 51019

(51) Int. Cl.
*B43K 7/12* (2006.01)
*B43K 24/08* (2006.01)

(52) U.S. Cl.
CPC ..... *B43K 24/082* (2013.01)

(58) Field of Classification Search
USPC ..... 401/117, 116, 99, 102, 103, 107
See application file for complete search history.

(56) References Cited

U.S. PATENT DOCUMENTS

| | | | | |
|---|---|---|---|---|
| 3,709,619 | A | 1/1973 | Zepell | |
| 3,740,159 | A * | 6/1973 | Smagala-Romanoff | 401/117 |
| 3,741,665 | A * | 6/1973 | Smagala-Romanoff | 401/117 |
| 5,967,684 | A | 10/1999 | Huang et al. | |
| 2009/0241703 | A1 | 10/2009 | Huang | |

FOREIGN PATENT DOCUMENTS

| | | |
|---|---|---|
| FR | 2 103 492 | 8/1971 |
| GB | 2 446 132 A | 6/2008 |

* cited by examiner

*Primary Examiner* — David Walczak
(74) *Attorney, Agent, or Firm* — Jones Day

(57) ABSTRACT

A writing instrument includes a body extending between a rear end and a front end of the body which has an opening, the body defining an inner volume; a writing member mounted inside the body and including a tip which protrudes from the front of the body; a protective element including a guide portion sliding along the body and a protective end which extends the guide portion and has an opening to allow the tip to pass through, the protective element being movable between a tip protection position and a retracted position for writing; an elastic return element coupled with the guide portion in order to bias the protective element towards the protection position; and a system for locking the retracted position.

13 Claims, 2 Drawing Sheets

WRITING INSTRUMENT HAVING A PROTECTIVE ELEMENT FOR THE RETRACTABLE TIP

CROSS REFERENCE TO RELATED APPLICATIONS

This application is a national stage application of International Application No. PCT/FR2013/050099, filed on Jan. 16, 2013, which claims the benefit of French Patent Application No. 1251019 filed on Feb. 3, 2012, the entire contents of both applications being incorporated herein by reference.

BACKGROUND OF THE INVENTION

1. Field of the Invention

The embodiments of the present invention relate to a writing instrument such as an ink pen. For example, the writing instrument may include: a body extending between a rear end and a front end which has an opening, the body defining an inner volume; a writing member mounted inside the body and including a tip which protrudes from the front of the body; a protective element including a guide portion sliding along the body and a protective end which extends the guide portion and has an opening to allow the tip to pass through, the protective element being movable between a tip protection position (position in which the protective end extends forwards at the front of the body, completely covering the tip) and a retracted position for writing (position in which the tip protrudes from the front of the protective element through the opening); and a system for locking the retracted position, which comprises a stop formed on the body, a locking member which engages with the stop to maintain the retracted position, and an unlocking portion which releases the locking member, the protective element including the locking member.

2. Description of Related Art

A writing instrument of the type mentioned above eliminates the use of a detachable cap that can be lost, while providing protection for the writing tip. Document FR 2,103,492 describes a writing instrument having a protective element with a substantially conical front end and for which the retracted position for writing is maintained by the introduction of a locking protrusion into a recess or groove formed on the outer face of the tubular body. This type of protective element has a spring clip provided with a ridged area to allow the user to push the protective element rearward into the retracted position for writing, where the locking member is engaged. The elasticity of the spring clip allows raising the protective element then pushing it forward to return to the protection position.

This type of actuation requires a certain agility in order to achieve the two positions and is not very suitable for young children for example. In addition, the thinning required to provide flexibility in the unlocking portion increases the risk of clip breakage.

SUMMARY OF THE INVENTION

The embodiments of the present invention aim to provide, for example, a writing instrument with a retractable protective element that is easy to actuate and is simple in design.

For this purpose, a writing instrument according to an embodiment of the present invention includes: a guide portion which slides axially within the body, the protective element being mounted in the body through said opening; an elastic return element for biasing the protective element towards the protection position; and a radially flexible elastic tab which is connected to the locking member and can be pressed radially inwards (typically towards the central axis) in response to an action, preferably a pressure, applied to the unlocking portion, knowing that the locking member disengages from the stop by an inward radial movement which unlocks the retracted position.

It is understood that the displacement of the tab caused by pressure (or another equivalent action on the unlocking portion) frees the locking member, allowing the protective element to slide towards the protection position due to the biasing of the elastic return element.

In this arrangement, the guide portion of the protective element, which extends longitudinally along a central axis, is inserted within the inner volume of the body. The elastic return element is preferably coupled with the guide portion to bias the protective element towards the protection position.

With these arrangements, the protection position can be obtained with minimal effort and with no need to exert a forward push, as the elastic return element ensures the forward slide of the protective element. One can see that it is no longer necessary to use an external clip.

In addition, because the protective element slides within the tubular body, the risk of its becoming stuck is reduced.

According to one feature of the invention, the guide portion includes the elastic tab, with the locking member formed on the elastic tab. Thus, the cooperation with the body in the writing position does not occur on the outer face of the body which is more exposed to wear and damage, rendering the mechanism more robust.

According to another feature of the invention, the guide portion includes a longitudinal slot which extends between a rear edge and a front edge, the elastic tab extending from the rear edge to a free front edge of the tab while diverging radially outward relative to the central axis of the guide portion. Preferably, the locking member is distanced from the rear edge and is closer to the front edge. This arrangement simplifies the design of the locking system, as the locking member is biased radially outward towards a position of engagement with the body.

According to another feature of the invention, the body has a window for accessing the unlocking portion, the unlocking portion being formed on the elastic tab and including a pin which traverses the access window to prevent rotation of the guide portion relative to the body. With this arrangement, it is possible to position the slot and the associated unlocking portion as close as possible to the protective end, meaning at a small distance from the position of the user's thumb when writing.

According to one feature of the invention, the unlocking portion has a front face which engages with the stop in the protection position, under the effect of the force exerted by the elastic return element. The unlocking can thus be obtained by radially disengaging the front face from the stop of the body, which can be achieved by simple inward radial pressure, as the action of the spring does the rest. This allows the user, at the end of the writing operation, to obtain the retracted position with minimal time and effort.

According to one feature of the invention, the unlocking portion has a free actuating edge, which projects radially outward relative to the body in order to exert an inward radial pressure on said elastic tab, the locking member disengaging from the stop by an inward radial displacement actuated by means of the unlocking portion. It is understood that the action of the user can simply consist of passing a finger, typically the thumb or index finger, over the access window while pressing in the actuating edge.

In certain embodiments, the unlocking portion may not be protruding but is still accessible indirectly. In this case, it can be arranged so that the unlocking portion can be moved by the user by means of a fingernail or a flexible actuating tab arranged on the tubular body (at the access window) and which can press against the unlocking portion. According to one feature of the invention, the protective element includes an annular shoulder which defines a rear face of the protective end, the protective end having an outer surface presenting at least one indentation to allow pushing the protective element rearward until the annular shoulder is bearing against the front end of the body. This arrangement minimizes the amount of material for the protective element, while allowing the user to move the protective element rearward in an effective manner.

According to another feature of the present invention, the locking member and the unlocking portion traverse the access window when the annular shoulder is bearing against the front end of the body. The body can thus have a single slot which combines the functions of rotation prevention and stop (on the front edge of the slot).

According to one feature of the invention, the writing member is mounted so as to be fixed in translation within the body. This ensures that the writing tip always protrudes in the same manner when the protective element is in the retracted position. In addition, this minimizes the number of parts compared to embodiments where the writing member slides.

In various embodiments of the writing instrument according to the present invention, it is possible for one or more of the following arrangements to be used: the elastic return element is a spring, preferably helical, including a rear end bearing in a fixed manner against a supporting face which is fixed in translation within the body, and a front end bearing directly or indirectly against the protective element; the body has two adjacent slots arranged one behind the other longitudinally and separated by a wall element forming said stop of the locking system, one of the two slots of the body being located further rearward and forming said access window, the unlocking portion moving within the access window between a position away from the stop and a position of engagement with the stop; the body opening is axial, and the other of the two slots (referred to as the forward slot as it is located more forward) extends longitudinally to the front end of the body which defines said opening, the locking member entering into the forward slot when the unlocking portion is in the position of engagement with the stop; and the protective element is made as a single part.

BRIEF DESCRIPTION OF DRAWINGS

Other features and advantages of the invention will be apparent from the following description of several embodiments, given as non-limiting examples, with reference to the accompanying drawings in which.

DETAILED DESCRIPTION

In the various figures, identical references denote identical or similar elements. The writing instrument 1 allows writing with any writing, erasing, or highlighting medium, referred to in the following description as ink, by means of a writing tip 4*c*.

Figure 1:
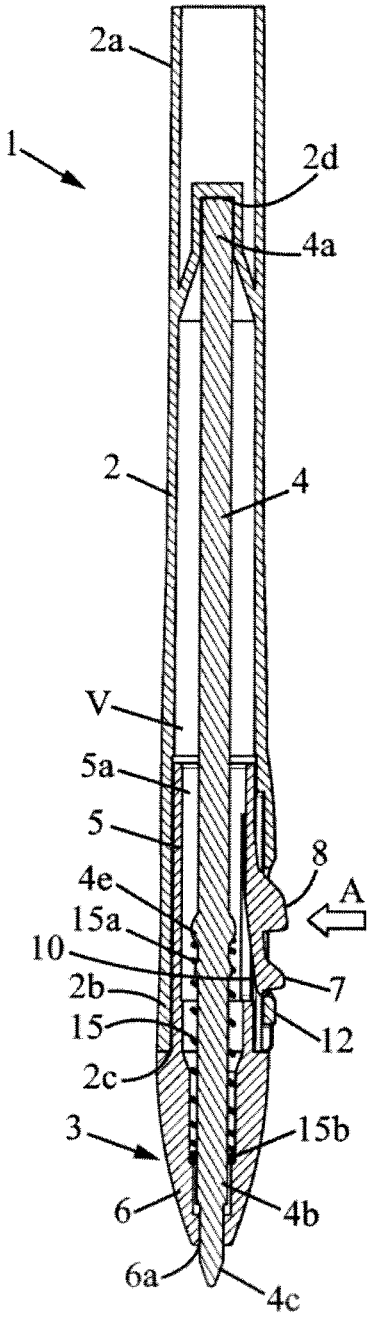
FIG. 1 is a diagram illustrating a longitudinal sectional view of an example of a writing instrument, with the protective element in the refracted position.
Figure 2:
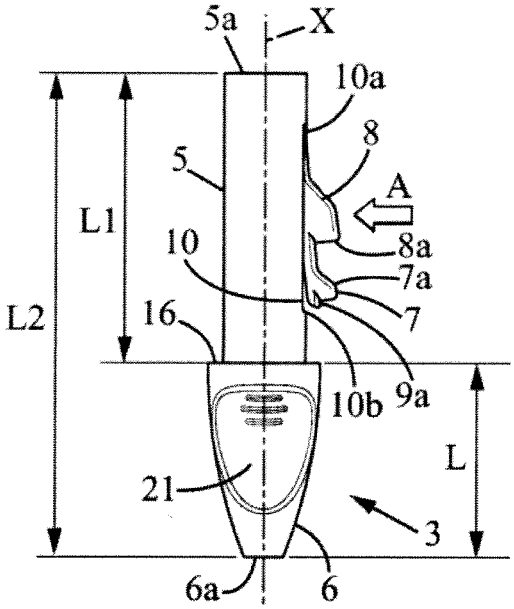
FIG. 2 is a diagram illustrating an example of the protective element of the writing instrument of FIG. 1.

Referring to FIGS. 1 and 2, the writing instrument 1 includes a body 2, preferably tubular, forming a barrel. This body 2 extends longitudinally between a rear end 2*a* and a front end 2*b* having an opening 2*c* which here is axial. The writing instrument does not have a cap but has a movable protective element 3 at the front of the body 2.

The writing member 4 housed inside the body 2 may have a generally cylindrical form, for example forming a cartridge (possibly replaceable by removing the rear end 2*a* of the body 2).

The writing member 4 is mounted so as to be fixed in translation within the body 2, pressing at its rear end 4*a* against a bottom 2*d* located here near the rear end 2*a* of the body 2. The bottom 2*d* may have a support with a base transverse to the longitudinal axis of the body 2 and teeth and/or at least one wall extending from the base to allow centering the writing member within the inner volume V of the body 2. The front end 4*b* of the writing member 4 has a tip 4*c* located outside the inner volume V and protruding at the front of the body 2 as is visible in FIG. 1.

The protective element 3 includes a guide portion 5, here generally tubular, which slides along the body 2 within the inner volume V. The guide portion 5 is extended forward by a protective end 6 which has an opening 6*a* to allow the tip 4*c* to pass through. This opening 6*a* is axial. An axial opening 5*a* is also provided at the rear of the guide portion 5. The protective element 3 forms the tapered front end of the writing instrument 1; the protective end 6 in particular may be conical or of similar shape. The guide portion 5 and the protective end 6 extend around the same longitudinal axis X, the guide portion 5 preferably having a generally cylindrical shape. When the body 2 is substantially asymmetric, the longitudinal axis X is a central axis for the protective element 3.

In the example illustrated in FIG. 1, the protective element 3 is mounted in the body 2 through the opening 2*c* formed in the front end 2*b* of the body 2, so that the guide portion of the protective element 3 is inserted into the inner volume V of the body 2. In the retracted position of the protective element 3 as shown in FIG. 1, the writing member 4 completely traverses the protective element 3 such that the writing instrument 1 is in a writing configuration.

With reference to the example illustrated in FIG. 2, the protective element 3 extends longitudinally along the longitudinal axis X, which typically coincides with the center axis of the body 2 (FIG. 1). The guide portion 5 of the protective element 3 here includes a locking member 7, intended to maintain the retracted position, and an unlocking portion 8.

The locking member 7 and the unlocking portion 8 project radially outward relative to the generally tubular shape of the guide portion 5. They also have some radial mobility due to a connection with a radially flexible elastic tab 9 which can be pressed radially inward (toward the axis X).

Figure 6:
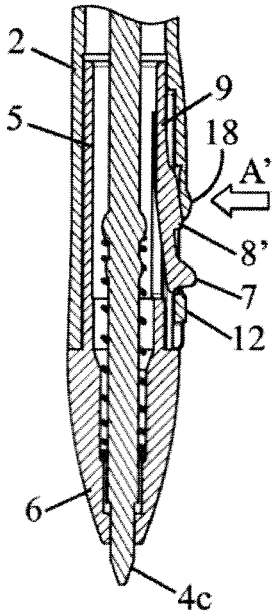
FIG. 6 is a diagram illustrating a detailed sectional view of an alternative embodiment of the writing instrument.

In the example embodiment in FIGS. 1, 2 and 6, the elastic tab 9 is integrally formed with the guide portion 5, and the locking member 7 is formed on the elastic tab 9.

The guide portion 5 may comprise a longitudinal slot 10 which extends between a rear edge 10*a* and a front edge 10*b*, the elastic tab 9 extending forward from the rear edge 10*a* while diverging radially outward, in a progressive manner, relative to the longitudinal axis X of the guide portion 5. The elastic tab 9 is flexible from a flex area adjacent to the rear edge 10*a*, so as to be able to move radially in response to an inward pressure. The flex area may have a thickness of the same order of magnitude as the thickness of the body 2. A plastic material of known type can be used to create the elastic tab 9.

Figure 5:
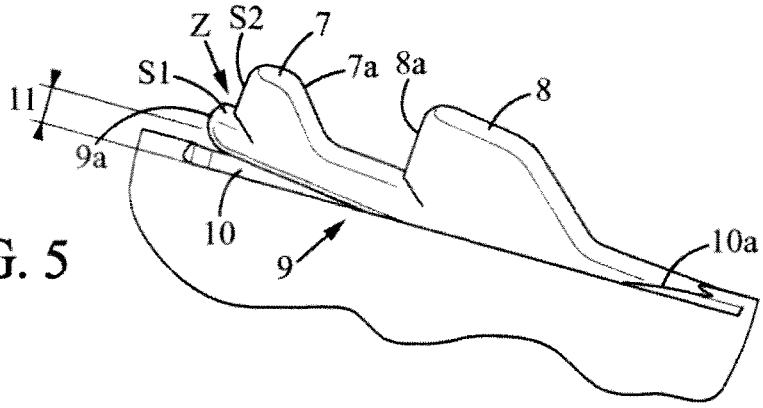
FIG. 5 is a diagram illustrating a detailed perspective view of an example of the elastic tab of the writing instrument of FIG. 1.

The locking member 7 is located near the free front edge 9*a* of the elastic tab 9, such that the displacement 11 (FIG. 5) of this locking member 7 in the radial direction is sufficient to allow said locking member to engage with the wall of the body 2 as will be described below. When the elastic tab 9 is pressed at a distance from the rear edge 10*a*, the locking member 7 can move a radial distance for example of more than 0.7 mm.

With reference to FIG. 1, the body 2 has an access window 2*f* for accessing the unlocking portion 8, which here is formed on the elastic tab 9. The access window 2*f* can be oblong or rectangular in shape, preferably with a width of less than or equal to 5 mm, for example about 2 or 3 mm. Also, the unlocking portion 8 does not project more than 2 or 3 mm outward for example in a preferred embodiment. In this manner, the engagement area is too reduced to allow the unlocking portion 8 to be twisted. In addition, the play between the actuating portion and the side edges of the window can be reduced to less than 1 mm for example. Because of the diverging direction of the elastic tab 9, the locking member 7 engages with a stop 12 of the body 2, which delimits the front edge B of the access window 2*f*. This blocks the protective element 3 in the retracted position, and the user is able to write in this configuration of the writing instrument 1. In a preferred embodiment, it is arranged so that in this retracted position, the locking member 7 and the unlocking portion 8 traverse the access window 2*f*, the elastic tab 9 then being in its rest configuration as is visible in FIG. 1 (no inward bend).

The shape of the locking member 7 may vary. Preferably, the locking member 7 has a convex surface 7*a* at the rear, as is particularly visible in FIG. 5, while at the front the surface is straight or is concave similarly to a hook, at least in the area of contact Z with the stop 12. By way of example, the area of contact Z with the stop 12 extends from the free front edge 9*a* and is divided into a first surface S1 in contact with the inner face of the body 2 (meaning below the wall element forming the stop 12), and a second surface S2 which extends transversely to the first surface S1. According to the exemplary non-limiting embodiment in FIGS. 1 and 5, it is understood that in the retracted position, the contact of the stop 12 with the first surface S1 opposes the radial deflection movement of the elastic tab 9, while the contact of the stop 12 with the second surface S2, here facing forward, opposes the axial forward movement of the protective element 3.

Figure 3:
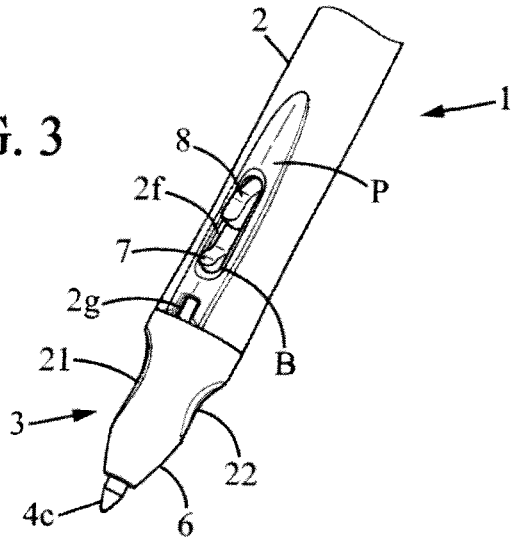
FIG. 3 is a diagram illustrating a perspective view of a portion of the writing instrument of FIG. 1.
Figure 4:
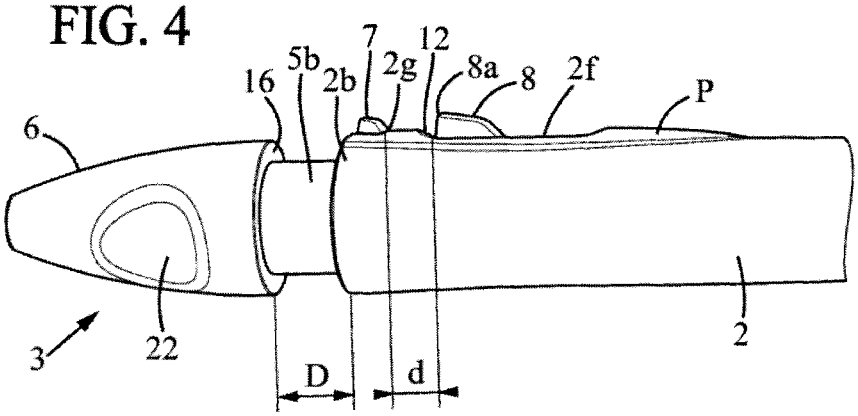
FIG. 4 is a diagram illustrating a side view of the writing instrument of FIG. 1, and the protection position of the protective element.

Referring to FIGS. 1, 3 and 4, the unlocking portion 8 includes a pin 8 which traverses the access window 2*f*, preventing rotation of the guide portion 5 relative to the body 2. To increase the radial displacement of the elastic tab 9, the access window 2*f* may be created on a projection P forming a slight outward protrusion relative to the rest of the wall of the body 2, which here is cylindrical. Alternatively, other cross-sectional shapes for the body 2, for example oval, could be used in order to have the slot 2*f* spaced further away from the longitudinal axis X of the protective element 3.

The unlocking portion 8 is arranged behind the locking member 7. Additionally, the stop 12 may also be used to block the advance of the protective element 3 into the protection position shown in FIG. 4, the pin of the unlocking portion 8 engaging with this stop 12. In this case, a particularly simple locking system is obtained, in which rapid disengagement of the stop 12 is made possible by a bending of the elastic tab 9. One will note that in the protection position, the tip 4*c* is not protruding and is properly covered by the protective element 3 where it is protected in the event of a frontal impact. Although this example illustrates a generally cylindrical shape for the body 2 and a circular shape for the annular shoulder 16, other shapes can of course be used, for example and without limitation with the body having a flattened face or with an oval cross-section.

In the non-limiting examples in the figures, the body 2 has a front slot 2*g* adjacent to the access window 2*f* so that they are arranged one behind the other longitudinally. The front slot 2*g* is separated from the access window 2*f* by the wall element forming the stop 12 of the locking system. The front slot 2*g* here extends longitudinally to the front end 2*b* of the body 2, which defines the opening 2*c*.

To facilitate obtaining the protection position for the tip 4*c*, the writing instrument 1 includes an elastic return element 15 coupled with the guide portion 5, for example positioned around the writing member 4 and pressing at its rear end 15*a* against a supporting face defined by a shoulder 4*e* of the writing member 4. In another example, the rear pressure could be on another supporting face which is fixed in translation within the body 2. The elastic return element 15, for example one or more helical springs, thus biases the protective element 3 towards the protection position, its front end 15*b* pressing against an inner shoulder of the protective end 6.

Preferably, a single helical spring is provided for biasing the protective element 3. In the non-limiting example in FIG. 1, the length of the spring can be greater than the length L of the protective end 3, the thrust of the spring in the protection position preferably being significantly lower than the thrust in the retracted position.

More generally, any biasing means can be used which provides a force bearing directly or indirectly against the protective element 3. Referring to FIG. 4, it is thus understood that, in an example, the protection position is achieved instantaneously after disengagement of the locking member 7. The unlocking portion 8 has a front face 8*a*, here present on the pin, which engages with the stop 12 in the protection position, under the effect of the force exerted by the elastic return element 15.

Still referring to FIG. 4, the forward sliding of the guide portion 5 reveals a coupling portion 5*b* for coupling with the protective end 6. At the connection with the protective end 6, an annular shoulder 16 is provided which defines a rear face of this protective end 6. As illustrated in the example in FIG. 4, the distance D between the annular shoulder 16 and the front end 2*b* of the body is slightly greater than the distance d, measured along the longitudinal axis of the body 2, which separates the access window 2*f* from the front slot 2*g*. This distance D is substantially equal to the axial distance between the locking member 7 and the unlocking portion 8.

The protective element 3 is movable between the protection position for the tip 4*c* and the retracted position for writing, preferably by axially sliding the guide portion 5. As can be seen in FIG. 4, the axial distance between the locking member 7 and the unlocking portion 8 is such that the locking member 7 enters the front slot 2*g* (in a position adjacent to the wall element separating the slot 2*g* from the access window 20, while the unlocking portion extends through the access window 2*f*, engaging with the stop 12.

When sliding, the elastic tab 9 is bent radially inwardly so that the locking member can move under the wall element of the body 2 which defines the stop 12.

The retracted position is obtained by a simple rearward sliding of the protective end 6, which corresponds to a movement of distance D. In other words, the user only has to push the protective element 3 rearward against the body 2, until the annular shoulder abuts against the front end 2*b* of the body 2 (end of travel when sliding). During this rearward sliding, the locking member 7 passes under the wall of the body 2, causing the elastic tab 9 to bend, and then comes back up through the access window 2*f*. The pressure against the wall of the body 2 by the convex surface 7*a* located at the rear of the locking member 7 generates a cam-like radial displacement of the flexible tab 9 toward the central axis X. This makes it possible to achieve both a rearward thrust of the protective element 3 and the locking in the refracted position, with a minimum of effort. This locking effect is obtained due to the deflection of the elastic tab 9 which occurs at the end of its travel, while the locking member 7 is free to enter the access window 2*f*.

According to the invention and with reference to FIGS. 1 to 4, the unlocking portion 8 projects radially outwards relative to the wall of the body 2 and can move within the access window 2*f* between a position away from the stop 12 (for the retracted position) and a position of engagement with the stop 12 (for the protection position). In this example, the unlocking portion 8 has an actuating free edge, which projects radially outwards relative to the body 2 and defines a surface suitable for exerting the radial thrust as indicated by the arrow A in FIGS. 1 and 2, so that the elastic tab 9 is pressed radially inward. The unlocking portion 8 therefore allows disengaging the locking member 7 from the stop 12 simply by means of this radial thrust towards the central axis X (arrow A). It is understood that the unlocking portion 8 actuates the radial inward movement of the locking member 7 to achieve disengagement, whereby the spring or similar elastic return element 15 is free to cause the locking member 7 to slide forward, passing under the stop 12.

The protective element 3 here is formed of a single piece of injected plastic. As illustrated in the embodiment in FIG. 1, the writing instrument 1 may include only two external parts: the tubular body 2 and the protective element 3. The writing member 4 and the associated elastic return element 15, here a helical spring, may form two other component elements of the writing instrument. This minimizes the number of parts for creating the locking system.

An alternative embodiment will now be described with reference to FIG. 6.

As is clearly visible in FIG. 6, the unlocking can be achieved in a slightly different manner in a second embodiment, although the type of movement of the protective element 3 and the locking in the retracted position remain similar otherwise. In this example, the tubular body 2 has a flexible tab 18 which overlies a portion of the elastic tab 9 and which is actuated by radial pressure toward the central axis X, as indicated by arrow A'.

In the refracted position, pressure on the flexible tab 18 in the direction of arrow A' bears on a protrusion 8' on the elastic tab 9 located rearward of the locking member 7, causing the elastic tab 9 to bend and the locking member 7 to disengage from the stop 12.

The protrusion 8' has a front end, for example in the form of a hook, suitable for engaging with the stop 12. The sliding of the guide portion 5 takes place, of course, in a manner entirely similar to that which was described in relation to FIGS. 1 to 4.

Although the figures show that the locking member 7 is visible externally in the protection position and in the refracted position of the protective element 3, it should be understood that the use of a front slot 2*g* or access window 2*f* is optional. Thus, the access window 2*f* could be replaced by a flexible covering portion, forming a flexible membrane for example, created in the body 2 facing the elastic tab 9. The flexible covering portion can then be deformed radially inwards and serve as a pushbutton for actuating the unlocking of the retracted position. In this retracted position, the locking member 7 is simply engaged with a rigid portion of the body 2 adjacent to the flexible covering portion. In this case the elastic tab 9 is made to bend in a manner entirely similar to what was described for the first embodiment and second embodiment.

In another embodiment, not shown, the stop 12 can have two surface regions, one beside the other, one intended for engagement with the protrusion 8' and the other intended for engagement with the locking member 7. In this case, the corresponding surfaces for engagement with the protrusion 8' and with the locking member 7 can be laterally offset relative to each other. More generally, it is understood that the forward sliding can be limited without the use of the elastic tab 9 (meaning without engagement by an unlocking portion 8 or protrusion 8' with the body 2). In another example, the guide portion 5 may have reliefs which stop the forward sliding of the protective element 3 by abutting against an internal shoulder formed in the front end 2*b* of the body 2.

Optional details in the arrangement of the protective element 3 and locking system will now be described with reference to FIGS. 2, 3, 4 and 6. These details may, of course, be applied to different embodiments of the invention.

In order to facilitate pushing the protective element 3 rearward, the outer surface of the protective end 6 may have, for example, one or two indentations 21, 22 to provide a better grip for two fingers (typically the thumb and index finger), without slipping. This arrangement improves the grip without increasing the radial dimensions of the protective end 6 (too large of a front end of the writing instrument 1 may be detrimental to comfortable writing).

As is best visible in FIG. 3, a larger first indentation 21 and a smaller second indentation 22 may be provided. This improves the grip when writing, by preventing the finger from sliding towards the slot 2*f*. Furthermore, the locking system (including the slot 2*f*, the stop 12, and the elastic tab 9) can be radially offset on the body 2, so that a natural displacement of the fingers, particularly the thumb, occurs on a portion of the wall that is distant from the slot 2*f*. In the non-limiting example of FIG. 3, the indentations 21, 22 are oriented in two opposing directions and the locking system is closer to the first indentation 21.

The guide portion 5 of the protective element 3 may have a length L1 that is slightly greater than the length L of the protective end 6, which here is conical in shape. This length L1 may satisfy the following relation:

$$0.5 \leq L/L1 \leq 0.75$$

This minimizes the amount of material required to create the protective element 3, and the locking system is advantageously located near the protective end 6 (therefore near the area for grasping the writing instrument 1 used when writing).

One of the advantages of the invention lies in the ergonomics of the writing instrument. A user is able to obtain the protection position for the tip 4*c* effortlessly, typically by moving the thumb a very small lateral distance in order to press on the unlocking portion 8 projecting through the access window 2*f*. It is also understood that the unlocking system is compact, as the general shape of the front portion of the tubular writing instrument can remain thin.

In addition, the design and assembly of the writing instrument 1 remain particularly simple, which makes it less expensive to manufacture.

It is understood that each of the examples and every detail of the embodiments described above may be used alone or in combination.

The invention claimed is:

1. A writing instrument comprising:

a body extending between a rear end and a front end of the body which has an opening, the body defining an inner volume;

a writing member mounted inside the body and comprising a tip which protrudes from the front end of the body;

a protective element comprising a guide portion sliding along the body and a protective end which extends the guide portion and has an opening to allow the tip to pass through, the protective element being movable between a tip protection position and a retracted position for writing;

an elastic return element coupled with the guide portion in order to bias the protective element towards the protection position; and a system for locking the retracted position, which comprises:

a stop formed on the body;

a locking member which engages with the stop to maintain the retracted position; and an unlocking portion which releases the locking member from the stop, the protective element comprising the locking member, wherein the protective element is mounted in the body through the opening, the guide portion of the protective element being inserted within the inner volume of the body and extending longitudinally along a longitudinal axis, characterized in that, in order to unlock the retracted position, the locking member disengages from the stop by a radial inward movement, the locking member being connected to a radially flexible elastic tab which can be pressed radially inwards in response to an action applied to the unlocking portion.

2. The writing instrument according to claim 1, wherein the guide portion comprises the elastic tab, with the locking member being formed on the elastic tab.

3. The writing instrument according to claim 2, wherein the guide portion comprises a longitudinal slot which extends between a rear edge and a front edge, the elastic tab extending from the rear edge to a free front edge of the tab while diverging radially outward relative to the longitudinal axis of the guide portion, the locking member being located near the free front edge.

4. The writing instrument according to claim 2, wherein the body has a window for accessing the unlocking portion, the unlocking portion being formed on the elastic tab and comprising a pin which traverses the access window to prevent rotation of the guide portion relative to the body.

5. The writing instrument according to claim 4, wherein the unlocking portion has a front face which engages with the stop in the protection position, under the effect of the force exerted by the elastic return element.

6. The writing instrument according to claim 4, wherein the unlocking portion has a free actuating edge, which projects radially outward relative to the body.

7. The writing instrument according to claim 4, wherein the body has two adjacent slots, a forward slot and a rearward slot, arranged one behind the other longitudinally and separated by a wall element forming the stop of the locking system, the rearward slot being located further rearward and forming the access window, the unlocking portion moving within the access window between a position away from the stop and a position of engagement with the stop.

8. The writing instrument according to claim 7, wherein the opening of the body is axial, and the forward slot of the body, which is located further forward, extends longitudinally to the front end of the body which defines the opening, the locking member entering into the forward slot when the unlocking portion is in the position of engagement with the stop.

9. The writing instrument according to claim 1, wherein the protective element comprises an annular shoulder which defines a rear face of the protective end, the protective end having an outer surface presenting at least one indentation to allow pushing the protective element rearward until the annular shoulder is bearing against the front end of the body.

10. The writing instrument according to claim 9, wherein the locking member and the unlocking portion traverse an access window formed on the body when the annular shoulder is bearing against the front end of the body.

11. The writing instrument according to claim 1, wherein the writing member is mounted so as to be fixed in translation within the body.

12. The writing instrument according to claim 1, wherein the elastic return element is a spring comprising:

a rear end bearing in a fixed manner against a supporting face which is fixed in translation within the body; and a front end bearing directly or indirectly against the protective element.

13. The writing instrument according to claim 1, wherein the protective element is made as a single part.

* * * * *